United States Patent [19]

Westerby

[11] 4,456,156

[45] Jun. 26, 1984

[54] UNLOADING APPARATUS FOR SILO

[76] Inventor: Palle N. G. Westerby, Hjortekaesvej 115, DK 2800 Lyngby, Denmark

[21] Appl. No.: 264,850

[22] Filed: May 18, 1981

[30] Foreign Application Priority Data

Apr. 9, 1980 [DK] Denmark ..... 3763/80

[51] Int. Cl.[3] ..... G01F 11/20

[52] U.S. Cl. ..... 222/415; 198/618

[58] Field of Search ..... 222/415, 559; 52/192–197; 198/618

[56] References Cited

U.S. PATENT DOCUMENTS

| | | | |
|---|---|---|---|
| 1,357,246 | 11/1920 | Morrison et al. | 52/197 |
| 1,617,228 | 2/1927 | Woodward | 222/415 |
| 2,519,929 | 8/1950 | Redler | 222/415 |
| 2,584,750 | 2/1952 | Spanski | 222/415 |
| 3,187,944 | 6/1965 | Stock | 222/415 |

FOREIGN PATENT DOCUMENTS

| | | | |
|---|---|---|---|
| 2943604 | 4/1980 | Fed. Rep. of Germany . | |
| 649801 | 1/1951 | United Kingdom | 222/415 |

*Primary Examiner*—Joseph J. Rolla
*Assistant Examiner*—Kenneth Noland
*Attorney, Agent, or Firm*—McGlew & Tuttle

[57] ABSTRACT

An apparatus for unloading a silo having side walls and a floor which includes a central chute that supplies material to a conveyor box which is covered except for the chute. A conveyor in the conveyor box conveys material from the central chute out through a material outlet in the silo. The central positioning of the chute causes a top surface of the remaining material in the silo to form itself into a conical shape having an apex moving toward the central chute. As the material is depleted to such an extent that the apex of the material surface meets the central chute, the remainder of the material is blown to a lower run of the conveyor and discharged from the floor of the silo.

10 Claims, 3 Drawing Figures

UNLOADING APPARATUS FOR SILO

FIELD AND BACKGROUND OF THE INVENTION

The present invention relates in general to a method and apparatus for unloading a silo which contains granular or particle material and, in particular to a new and useful construction and unloading technique for a silo which unloads the silo in stages so that an even distribution of force is exerted by the remaining material within the silo, at all times. The silo is initially unloaded from a central chute so that the top surface of the remaining material within the silo forms into a substantially conical shape. The force exerted by the material on the interior walls of the silo therefore remain substantially equalized and even.

In the past, silos have been unloaded in such a manner that, one side of the silo may remain substantially full of material while an opposite side becomes depleted of material. Such a configuration of material within the silo causes uneven loading forces on the interior walls of the silo. Particularly in the case where the silo foundation or support is inadequate, such uneven loading may upset the silo and substantially increase the risk of accidents.

SUMMARY OF THE INVENTION

Accordingly, it is an object of the invention to provide a silo unloading method and apparatus which maintains an even distribution of force exerted by the material on the interior wall of the silo throughout the unloading operation.

A silo is provided which has a non-tapering or flat bottom. The silo contains pulverous or granular material and includes a central unloading chute for unloading a major part of the material. Structure and technique is disclosed for unloading the remaining portion of the material from the silo.

As material is withdrawn from the central opening or chute, the top surface of the remaining material within the silo forms into a conical shape having a bottom central apex substantially over the central opening or chute. When the apex of the conical shape meets the central chute or opening, the material no longer slides down the conical shape and into the central opening. At this point, material is unloaded from the bottom or floor of the chute until the entire contents of the silo is removed.

In this fashion, an even load distribution is always applied on the interior walls of the silo by the material throughout the unloading operation.

Another object of the invention is to provide an apparatus for achieving the method which includes a central chute positioned above the silo bottom or floor. A drag chain box is provided beneath the chute. The portion of the drag chain box not directly beneath the chute is covered by a casing or cover member so that only material supplied through the chute is conveyed by a drag chain within the drag chain box. A partition is positioned between an upper run and a lower run of the drag chain box and extends toward an outer wall of the silo.

Openings are provided near the bottom of the drag chain box for supplying material to a lower run of the drag chain. These openings however, are covered until the material can no longer be supplied through the chute. The material is thus extracted in an orderly and even fashion. Only the material from the center of the silo is initially discharged through the central chute. Only after the apex of the cone formed on the top surface of the remaining material reaches the chute, does the material begin to flow through the drag chain box openings.

Another feature of the invention requires the upper run of the drag chain to convey material toward one wall of the silo and the lower run of the drag chain to convey material toward an opposite wall of the silo. The lower run of the drag chain moves material over the silo bottom or floor toward the opposite wall of the silo. As a result, the material moved from the chute during the unloading operation will close the inlet openings near the bottom of the drag chain box.

Air injection channels extend transversely of the cover member and over the silo bottom or floor. These channels are supplied with air to blow material across the silo bottom, i.e. which bottom along with the silo side wall inherently support the material outwardly or peripherally of the central chute, and into the drag chain box opening. The material thus conveyed is moved by the lower run of the drag chain, out of the silo.

Another object of the invention is to provide such a device for unloading a silo which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
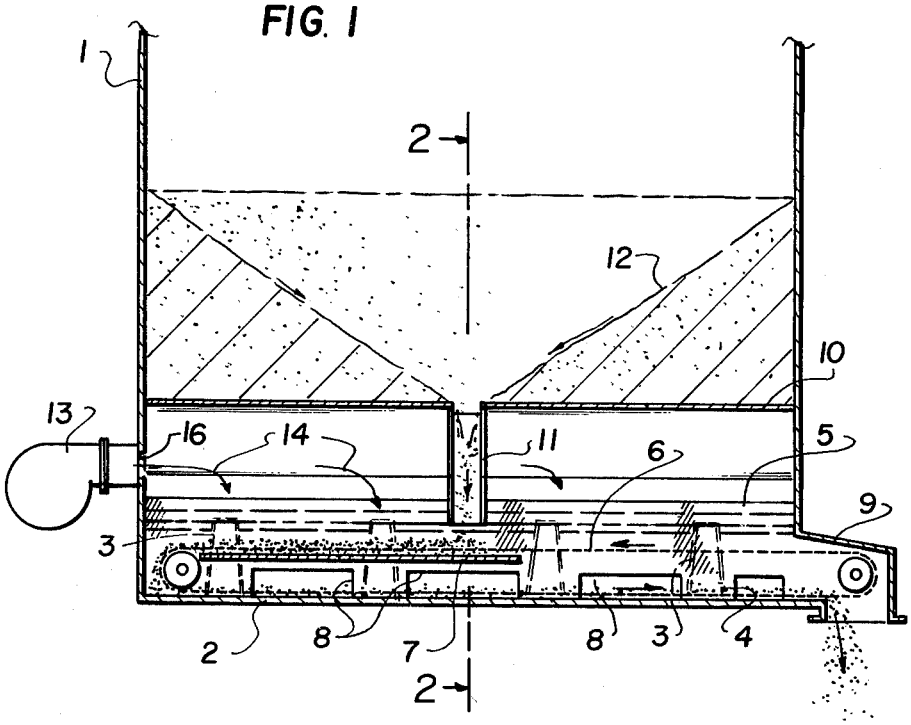
FIG. 1 is a partial central sectional view taken through a lower part of a silo constructed according to the invention.

Turning to the drawings in particular, the invention embodied therein, in FIG. 1 comprises a silo having side walls, or a single cylindrical side wall 1 and a non-tapering or flat bottom or floor 2.

Figure 3:
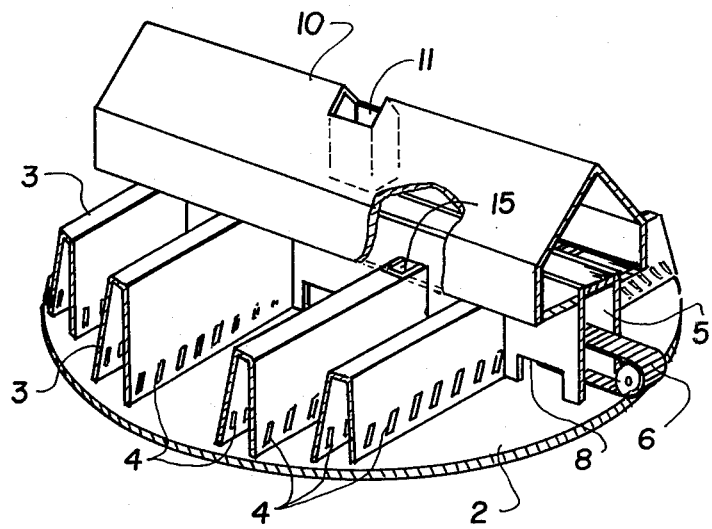
FIG. 3 is a perspective view with portions cut away of the unloading assembly positioned near the bottom and on the floor of a silo according to the invention.

As best shown in FIG. 3, a drag chain or conveyor 6 is positioned near the bottom and across the width of the silo which is mounted with a drag chain box 5. Most of the drag chain box 5 is covered by a cover member or casing 10 which includes a substantially centrally located chute or opening 11. Air channels 3 extend transversely of the cover member 10 and include, on the lateral walls thereof and near the silo bottom 2, a plurality of inclined slits or openings 4 for the passage of air.

Figure 2:
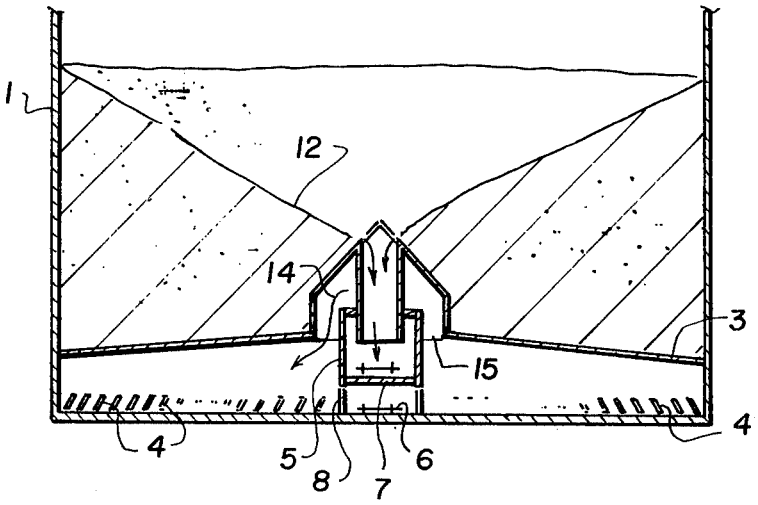
FIG. 2 is a view taken along line 2—2 of FIG. 1.

Referring to FIGS. 1 and 2, a partition 7 is positioned within and across at least a major part of the drag chain box 5. In an initial stage of the unloading operation, material continually falls through chute 11 and onto partition 7. The drag chain or conveyor 6 is moved in a direction of the two arrows and thus conveys material across the top of the partition or box floor 7 to the left as shown at FIG. 1. The material then drops off the end of conveyor 6 and is dragged along the bottom or floor 2 by the lower run of conveyor 6. The material eventually is discharged from a material outlet 9 by the lower run of the drag chain conveyor 6. As the material is continually discharged through chute 11, a substantially conical shape 12 is formed on a top surface of the material remaining in the silo. In this manner, an even force is exerted on all sides of the interior wall of the silo.

When the apex or lower part of conical surface 12 meets the opening of chute 11, the first stage of the unloading operation is completed.

At this point, a blower 13 or the like is activated which blows air into an air supply port 16. The air moves generally in a direction of arrows 14 into a top air inlet 15 of the air channels 3. The air moving in air channels 3 then moves outwardly through slits or openings 4. These openings are shaped so as to blow material across the bottom or floor 2 and into openings 8 provided in the drag chain conveyor box 5. The material is thus supplied to the lower run of drag chain conveyor 6 and discharged out through material outlet 9.

The slits are shaped so that the air discharged therethrough is directed obliquely downwardly toward the silo bottom or floor 2 and the conveyor 6.

Due to the presence of box floor or partition 7, and the material covering openings 4 and 8, no material is conveyed through these openings until the apex of the conical shape 12 has met the opening of chute 11. The material itself acts as a closing valve for these openings until an appropriate time in the unloading operation.

It should also be noted that, with the drag chain conveyor 6 stopped, the conveyor itself will act as a damper and prevent unloading of additional material from the silo. In this case, the blower 13 can be used to dry the material within the silo which, for example, may be grain.

In the embodiment shown, the openings 8 in the conveyor chain box 5 are positioned between adjacent air injection channels 3. In an alternate form of the invention, the air injection channels 3 may be positioned above the silo floor or bottom 2 and provided with slits at the bottom thereof to direct air downwardly toward the floor 2. In this case, the openings 8 may be positioned in the chain box 5 immediately below the air injection channels 3.

While a specific embodiment of the invention has been shown and described in detail to illustrate the application of the principles of the invention, it will be understood that the invention may be embodied otherwise without departing from such principles.

What is claimed is:

1. Device for unloading a silo having at least one side wall and a floor, for containing pulverous or granular material supported on the silo floor and by the at least one silo side wall, comprising:

a central material chute disposed centrally in the silo and arranged above the silo floor and inwardly spaced from the silo side wall for permitting the supporting of the material on the silo floor and by the silo side wall, a conveyor box disposed below the chute and above the silo floor for receiving material from the chute, a conveyor in the conveyor box and above the silo floor for conveying material from the chute to a material outlet in the silo, and a cover member above the box and covering the box except for the chute, whereby the conveyor is activated to convey material out of the silo through the central chute so that substantially even forces are exerted by a remainder of material in the silo on the at least one side wall of the silo.

2. Device of claim 1 wherein the conveyor comprises a drag chain conveyor having an upper run moving past the central material chute and a lower run extending over the silo floor, and a partition extending in the conveyor box between the upper and lower runs of the drag chain and substantially toward one end of said silo side wall.

3. Device of claim 2, wherein the silo floor is substantially flat.

4. Device of claim 3, wherein the at least one side wall of the silo is cylindrical.

5. Device for unloading a silo having at least one side wall and a floor, for containing pulverous or granular material comprising:

a central material chute disposed centrally in the silo and above the silo floor, a conveyor box below the chute for receiving material from the chute to a material outlet in the silo, a conveyor in the conveyor box for conveying material from the chute to a material outlet in the silo, and wherein the conveyor comprises a drag chain conveyor having an upper run moving past the central material chute and a lower run extending over the silo floor, and a partition extending in the conveyor box between the upper and lower runs of the drag chain and substantially toward one end of said silo side wall, and a cover member above the box covering the box except for the chute, whereby the conveyor is activated to convey material out of the silo through the central chute so that substantially even forces are exerted by a remainder of material in the silo on the side wall of the silo, and including air injection means for blowing air across the silo floor and toward the lower run of the drag conveyor, whereby material is conveyed from the silo after a level of material in the silo reaches the material chute.

6. Device of claim 5, wherein said air injection means comprise a plurality of air injection channels extending transversely of the conveyor box, each channel having an air inlet and a plurality of air outlet slits shaped to blow air toward the silo floor and the conveyor, said conveyor box having a plurality of openings for receiving material from the silo floor and into the vicinity of the lower run of the drag conveyor, and a blower connected to the air injection channel inlet.

7. Device of claim 6, wherein said cover member has a central peak extending upwardly, said chute being positioned centrally of said cover member and having a material inlet extending through the cover member peak.

8. Device of claim 6, wherein said conveyor box openings are positioned between adjacent air injection channels.

9. Device of claim 5, wherein the silo floor is substantially flat.

10. Device of claim 9, wherein the at least one side wall of the silo is cylindrical.

* * * * *